US008969698B1

(12) United States Patent
Suzuki

(10) Patent No.: US 8,969,698 B1
(45) Date of Patent: Mar. 3, 2015

(54) KEYBOARD CHASSIS AND KEY GUIDE STRUCTURE FOR KEYBOARD INSTRUMENT

(71) Applicant: Kabushiki Kaisha Kawai Gakki Seisakusho, Hamamatsu-shi, Shizuoka-ken (JP)

(72) Inventor: Akihiro Suzuki, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 14/514,983

(22) Filed: Oct. 15, 2014

(30) Foreign Application Priority Data

Oct. 18, 2013 (JP) ..... 2013-217306
Oct. 21, 2013 (JP) ..... 2013-218144

(51) Int. Cl.
*G10C 3/12* (2006.01)

(52) U.S. Cl.
CPC ..... *G10C 3/12* (2013.01)
USPC ..... 84/436

(58) Field of Classification Search
USPC ..... 84/423 R, 432–438, 171, 174, 177
See application file for complete search history.

(56) References Cited

U.S. PATENT DOCUMENTS 7,411,122 B2 * 8/2008 Yamaguchi ..... 84/423 R
8,350,140 B2 * 1/2013 Taniguchi ..... 84/423 R

FOREIGN PATENT DOCUMENTS

JP 11-296162 10/1999
JP 2000-122654 4/2000
JP 2005-070644 3/2005

* cited by examiner

*Primary Examiner* — Kimberly Lockett
(74) *Attorney, Agent, or Firm* — Christie, Parker & Hale, LLP

(57) ABSTRACT

A keyboard chassis capable of preventing deformation of the keyboard chassis even when the keyboard instrument is stored in an upright position, and a key guide structure capable of stably guiding a key without generating noise. The keyboard chassis is provided with a plurality of connection parts connecting between a rear support part and a front support part. Each connection part includes a plate-shaped vertical rib continuous with the rear support part and the front support part, and a plate-shaped reinforcement rib disposed on an upper end of the vertical rib, with a width increased in the left-right direction. The key guide structure includes key guide holders each having a mounting portion, and key guide bodies each mounted in the mounting portions in a state inserted from above, for being brought into sliding contact with inner side surfaces of a guide recess of each key.

9 Claims, 9 Drawing Sheets

KEYBOARD CHASSIS AND KEY GUIDE STRUCTURE FOR KEYBOARD INSTRUMENT

CROSS-REFERENCE TO RELATED APPLICATION(S)

This application claims priority to and the benefit of Japanese Patent Application No. 217306/2013, filed on Oct. 18, 2013 and Japanese Patent Application No, 218144/2013, filed on Oct. 21, 2013, the disclosures of which are hereby incorporated by reference in their entirety.

BACKGROUND OF THE INVENTION

1. Field of the Invention

The present invention relates to a keyboard chassis for a keyboard instrument, which is applied to a keyboard instrument, such as an electronic piano, and configured to support a plurality of keys and hammers in a state arranged in the left-right direction, and more particularly to a construction of a keyboard chassis formed as a molded article made of a synthetic resin and a key guide structure for guiding a key pivotally moved by key depression.

2. Description of the Related Art

Conventionally, the present applicant has already proposed a keyboard chassis for an electronic piano in Japanese Laid-Open Patent Publication (Kokai) No. 2005-70644. A keyboard device of the electronic piano having the keyboard chassis includes a plurality of keys extending in a front-rear direction and a plurality of hammers provided for the keys, respectively, and the keyboard chassis pivotally supports the keys and hammers. The keyboard chassis is formed as a molded article made of a synthetic resin, such as an ABS resin. The keyboard chassis of the whole electronic piano is formed by connecting a plurality of keyboard chassis each corresponding to one octave in the front-rear direction form.

The keyboard chassis made of a synthetic resin is configured such that a rear part thereof (referred to as "the chassis rear" in this section) pivotally supports keys, and further, a front part thereof (referred to as "the chassis front" in this section) guides each key pivotally moved by key depression and supports a hammer associated with the key and moved in a manner interlocked with the key depression. Further, the keyboard chassis is provided with a multiplicity of vertical ribs that connect between the chassis rear and the chassis front while maintaining a space therebetween for pivotal motion of each hammer. Specifically, each vertical rib is formed in a plate shape having a predetermined thickness in a left-right direction and is disposed in a manner dividing between hammers adjacent to each other in the left-right direction.

Further, conventionally, the present applicant has already proposed a key guide structure for a keyboard instrument in Japanese Laid-Open Patent Publication (Kokai) No. 2000-122654. A keyboard device of an electronic piano to which the key guide structure is applied includes a plurality of keys each extending in a front-rear direction and having an inverted U shape in cross-section formed by a top wall and left and right walls, and a keyboard chassis holding these keys in a state arranged in a left-right direction and pivotally supporting each key by a rear end thereof. A key guide is provided on the keyboard chassis for each key for guiding the key being pivotally moved. Further, in this keyboard device, each key and keyboard chassis are both formed as molded articles made of a hard synthetic resin. Each key guide is erected below a front end or its vicinity of a key associated therewith and is formed in a plate shape having a lateral width substantially equal to a distance between left and side walls of the key, with a lubricant such as grease applied to left and right sides of the key guide.

Further, there has also conventionally been proposed another key guide structure for a keyboard device in Japanese Laid-Open Patent Publication (Kokai) No. H11-296162. A key guide described in this publication is formed by mounting a guide member made of rubber on a guide member-holding part formed in a manner projecting upward. The guide member is formed in a hollow cylindrical shape and is mounted on the guide member-holding part in a state having the guide member-holding part inserted into the inside thereof.

In the key guide structures as proposed in Japanese Laid-Open Patent Publication (Kokai) No. 2000-122654 and Japanese Laid-Open Patent Publication (Kokai) No. H11-296162, when a key is in a key-released state, an upper end of the associated key guide is engaged with the key in a state slightly inserted therein. In this key-released state, when the key is depressed, the key guide is engaged with the key in a manner deeply inserted therein, thereby guiding the key being pivotally moved such that the key is prevented from swinging in the left-right direction, i.e. while preventing lateral swing of the key.

In the keyboard chassis described above, relatively high rigidity thereof is ensured by provision of a multiplicity of vertical ribs that connect the chassis rear and the chassis front. However, since the number of vertical ribs is large, the amount of a synthetic resin used as a material for molding the keyboard chassis is increased. Of course, it is possible to reduce the amount of used material for the keyboard chassis by reducing the number of vertical ribs.

However, in such a case, there arises the following problem: Assuming that the electronic piano is stored in a room in an upright position in which the left and right sides thereof are in vertically opposite positions, if the room temperature becomes very high e.g. in summer, the vertical ribs made of a synthetic resin tend to be bent downward due to the self weight of the keyboard chassis and the weight of the hammers, which can cause deformation of the keyboard chassis. In this case, there is a possibility that when a key is depressed, a hammer associated therewith cannot be smoothly moved or that noise is generated due to rubbing of the pivotally moved key or hammer against the keyboard chassis.

On the other hand, as to the key guide structure, in Japanese Laid-Open Patent Publication (Kokai) No. 2000-122654 mentioned above, the keys and key board chassis are made of a hard synthetic resin, and hence when the lubricant applied to the key guides becomes short due to long-term use of the electronic piano, noise can be generated by rubbing of the inner surfaces of each key against the key guide when sliding thereon. Further, in a case where the amount of lubricant applied to the key guide is too much, there can arise a problem that the lubricant can leak out of the key. On the other hand, in Japanese Laid-Open Patent Publication (Kokai) No. H11-296162, sine the guide member is formed in a hollow cylindrical shape which covers the outside of the guide member-holding part, the amount of a material used for forming the guide member becomes relatively large, resulting in increased costs.

SUMMARY OF THE INVENTION

It is a first object of the present invention to provide a keyboard chassis for a keyboard instrument, which makes it possible to ensure sufficient rigidity while reducing the amount of a synthetic resin used as a material, and prevent deformation of the keyboard chassis even when the keyboard instrument is stored in an upright position.

Further, it is a second objet of the present invention to provide a key guide structure for a keyboard instrument, which makes it possible to stably guide a key being pivotally moved by key depression without generating noise, and reduce manufacturing costs.

To attain the first object, in a first aspect of the present invention, there is provided a keyboard chassis for a keyboard instrument, which is formed as a molded article made of a synthetic resin and configured to support a plurality of keys and hammers each extending in a front-rear direction, in a state arranged in a left-right direction, including a rear support part configured to pivotally support a rear end of each of the keys, a front support part disposed forward of the rear support part with a spacing therefrom, and having a key guide part that guides the keys each pivotally moved by key depression and/or a hammer support part that pivotally supports the hammers each moved in a manner interlocked with the key depression, and a plurality of connection parts disposed with a spacing therebetween in the left-right direction and configured to connect between the rear support part and the front support part, wherein each connection part comprises a vertical rib formed in a plate shape having a predetermined thickness in the left-right direction and continuous with the rear support part and the front support part, and a reinforcement rib formed in a plate shape having a predetermined thickness in a vertical direction, and disposed on an upper end of the vertical rib between the rear support part and the front support part, with a width made larger in the left-right direction than the thickness of the vertical rib.

With the construction of the keyboard chassis, the plurality of keys each have a rear end thereof pivotally supported on the rear support part of the keyboard chassis. Further, the front support part of the keyboard chassis includes a key guide part that guides the keys each pivotally moved by key depression and/or a hammer support part that pivotally supports the hammers each moved in a manner interlocked with the key depression. The rear support part and the front support part are connected by the plurality of connection parts disposed with a spacing therebetween in the left-right direction.

Each connection part has a vertical rib formed in a plate shape having a predetermined thickness in the left-right direction, and the vertical rib is continuous with the rear support part and the front support part. Further, the reinforcement rib formed in a plate shape having a predetermined thickness in a vertical direction is disposed on an upper end of the vertical rib between the rear support part and the front support part, with a width made larger in the left-right direction than the thickness of the vertical rib. This makes it possible to make the connection part much stronger than in the case of the connection part being formed by the vertical rib alone, and reduce the number of connection parts (vertical ribs) while maintaining sufficient rigidity of the keyboard chassis, compared with the conventional keyboard chassis in which vertical ribs are disposed in a manner dividing between hammers adjacent to each other in the left-right direction. As a consequence, compared with the prior art, it is possible to ensure the rigidity while reducing the amount of a synthetic resin as a material and in addition prevent deformation of the keyboard chassis even when the keyboard instrument is stored in an upright position.

Preferably, the plurality of connection parts are each provided for every predetermined two or larger number of keys and/or hammers.

With this construction, compared with the conventional keyboard chassis having vertical ribs arranged in a manner dividing between hammers adjacent to each other, the number of connection parts is reduced, whereby it is possible to reduce the amount of a synthetic resin used a material.

Preferably, the reinforcement rib is formed such that the width in the left-right direction is progressively increased from one of the rear support part and the front support part toward the other.

With this construction, while maintaining sufficient strength of each connection part, it is possible to reduce the amount of the material, compared with a case where the reinforcement rib is formed with an increased width in the left-right direction over a whole length thereof in the front-rear direction.

To attain the second object, in a second aspect of the present invention, there is provided a key guide structure for a keyboard instrument including a plurality of keys each extending in a front-rear direction, having a rear end thereof pivotally supported on a keyboard chassis, and having a guide recess open downward, the key guide structure provided for guiding each key pivotally moved by key depression, comprising a plurality of key guide holders each of which has a mounting portion open upward and extending therethrough in a left-right direction, and is provided for each of the keys, in a manner erected on the keyboard chassis at a location below the guide recess, and a plurality of key guide bodies each of which is made of a soft synthetic resin and formed in a plate shape having a width substantially identical in dimension to an inner width of the guide recess of the key in the left-right direction, each key guide body being mounted in the mounting portion of an associated one of the key guide holders in a state inserted therein from above, for being brought into sliding contact with left and right inner side surfaces of the guide recess of the associated key.

With this construction of the key guide structure, the plurality of keys each extending in a front-rear direction each have a guide recess open downward, and have a rear end thereof pivotally supported on a keyboard chassis. The plurality of key guide holders each having a predetermined mounting portion are erected for each key on the keyboard chassis at a location below the guide recess, and a key guide body is mounted in the mounting portion of an associated one of the key guide holders in a state inserted therein from above. Each key guide body is formed in a plate shape having a width substantially identical in dimension to the inner width of the guide recess of the key in the left-right direction, for being brought into sliding contact with left and right inner side surfaces of the guide recess. Therefore, when a key is depressed, the key is pivotally moved about the rear end thereof, and is guided by having the left and right inner side surfaces of the guide recess slid on the left and right sides of the key guide body.

Further, the key guide body is made of a soft synthetic resin, and hence, even when the key is made of a hard synthetic resin, and the inner side surfaces of the guide recess rub against the key guide body, the sliding noise generated thereby can be greatly reduced, whereby it is possible to stably guide the key without generating noise. Further, since the key guide body is formed in a plate shape, compared with a case where the guide member is formed in a cylindrical shape, it is possible to reduce the amount of a synthetic resin as a material, thereby reducing the manufacturing costs.

Preferably, the key includes left and right side walls with a predetermined spacing therebetween in the left-right direction, and left and right guide walls that are provided at respective locations spaced inward from the left and right side walls by a predetermined distance, in a manner spaced from each other by a distance substantially equal to a lateral width of the key guide body in the left-right direction, the left and right guide walls forming left and right walls of the guide recess, respectively.

With this construction, the key having left and right side walls with a predetermined spacing therebetween in the left-right direction is provided with left and right guide walls that are provided at respective locations spaced inward from the associated side walls by a predetermined distance. Further, these guide walls are spaced from each other by a distance substantially equal to a lateral width of the key guide body in the left-right direction, and form left and right walls of the guide recess, respectively. Therefore, by providing each guide wall at a locations sufficiently spaced from the associated side wall, it is possible, even when a relatively large amount of a lubricant such as grease is applied to the key guide body, to positively prevent the lubricant from leaking out of the key.

Preferably, the key guide body has left and right side surfaces each formed with a groove for holding a lubricant.

With this construction, when a lubricant is applied to left and right sides of the key guide body, part of the lubricant enters the groove to be held therein. This makes it possible to maintain a state in which the lubricant is held in the left and right sides of the key guide body for a long term, thereby ensuring lubricity between the side walls of the guide recess of the key and the sides of the key guide body during key depression.

Preferably, the key guide body has a retaining portion provided at a lower end thereof, the retaining portion being configured to be engaged with the key guide holder in a retained state when the key guide body is mounted in the mounting portion.

With this construction, the key guide body is engaged with the key guide holder in a retained state when the key guide body is mounted in the mounting portion by inserting the same into the mounting portion of the key guide holder from above. This makes it possible to securely attach the key guide body to the key guide holder, and prevent the key guide body from dropping off the key guide holder even when the guide recess of the key is in sliding contact with the key guide body during key depression.

Preferably, the key guide holder includes a holder body formed in a hollow cylindrical shape extending vertically and having the mounting portion, and a reinforcement part erected on the keyboard chassis at at least one of locations forward and rearward of the holder body, in a state continuous with the holder body.

With this construction, the holder body having the mounting portion is formed in a hollow cylindrical shape extending vertically, and the key guide body is mounted to the holder body. Further, the reinforcement part is provided at at least one of locations forward and rearward of the holder body, and hence it is possible to reinforce the holder body by the reinforcement part against load in the front-rear direction. As a consequence, it is possible to securely hold the key guide body mounted on the holder body.

More preferably, the reinforcement part is formed in a hollow shape extending vertically.

With this construction, the reinforcement part of the key guide holder is formed in a hollow shape extending vertically, and hence it is possible to reinforce the holder body against not only the load in the front-rear direction but also load in the left-right direction. As a consequence, it is to more securely hold the key guide body mounted on the holder body.

The above and other objects, features, and advantages of the present invention will become more apparent from the following detailed description taken in conjunction with the accompanying drawings.

BRIEF DESCRIPTION OF THE DRAWINGS

FIGS. 7A and 7B are views useful in explaining ribs of the keyboard chassis, in which:

FIG. 7A is a perspective view showing a reinforcing rib; and

FIG. 7B is a plan view showing the keyboard chassis, with the reinforcing rib viewed as a center thereof.

FIGS. 8A and 8B are views useful in explaining a white key guide part, in which:

FIG. 8A is a perspective view showing a left white key guide part in a state where a key guide body has been mounted to a key guide holder and a right white key guide part in a state where a key guide body has been removed from a key guide holder; and FIG. 8B is a plan view showing the left and right white key guide parts in the respective same states as shown in FIG. 8A.

FIGS. 11A and 11B are views useful in explaining the relationship between a white key and an associated white key guide part, in which:

FIG. 11A is a perspective view of a front end of the white key cut vertically and viewed from below; and FIG. 11B is a plan view of the white key of which an upper portion is horizontally cut to show the relation between the white key and the white key guide part.

DETAILED DESCRIPTION OF PREFERRED EMBODIMENTS

Figure 1:
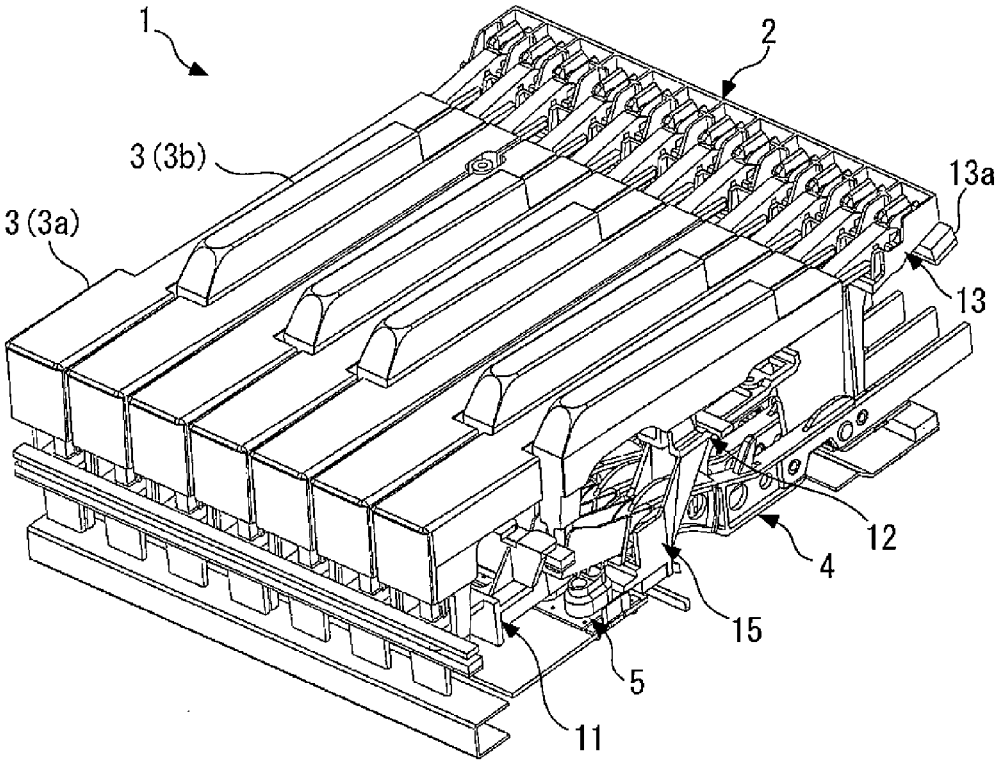
FIG. 1 is a perspective view of a keyboard device (for one octave section) of an electronic piano to which is applied a keyboard chassis and a key guide structure according to an embodiment of the present invention.
Figure 2A:
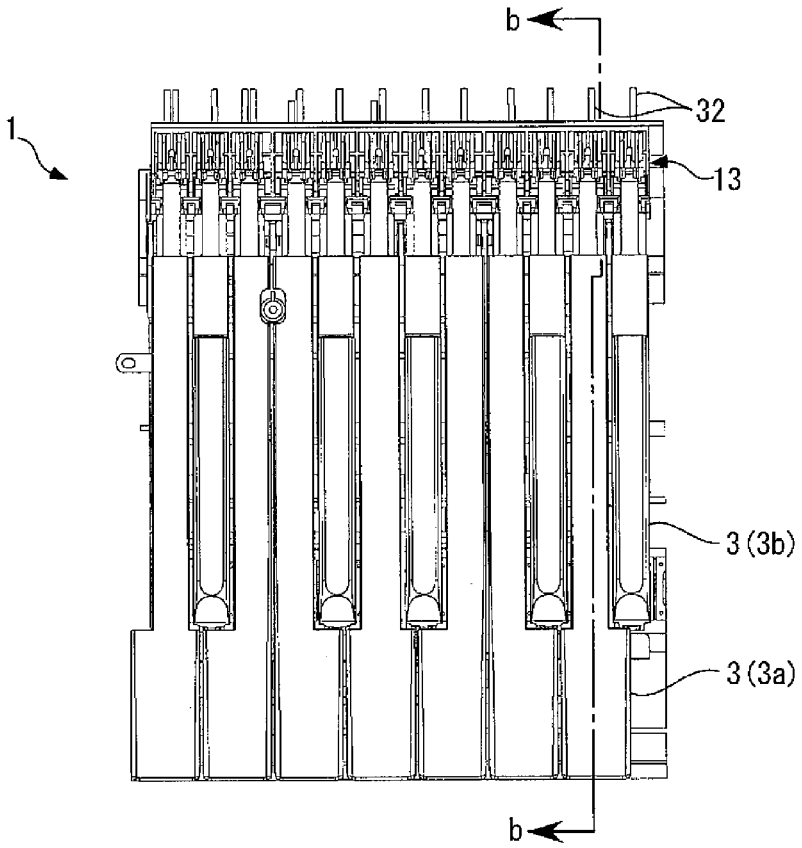
FIG. 2A is a plan view of the keyboard device shown in FIG. 1.
Figure 2B:
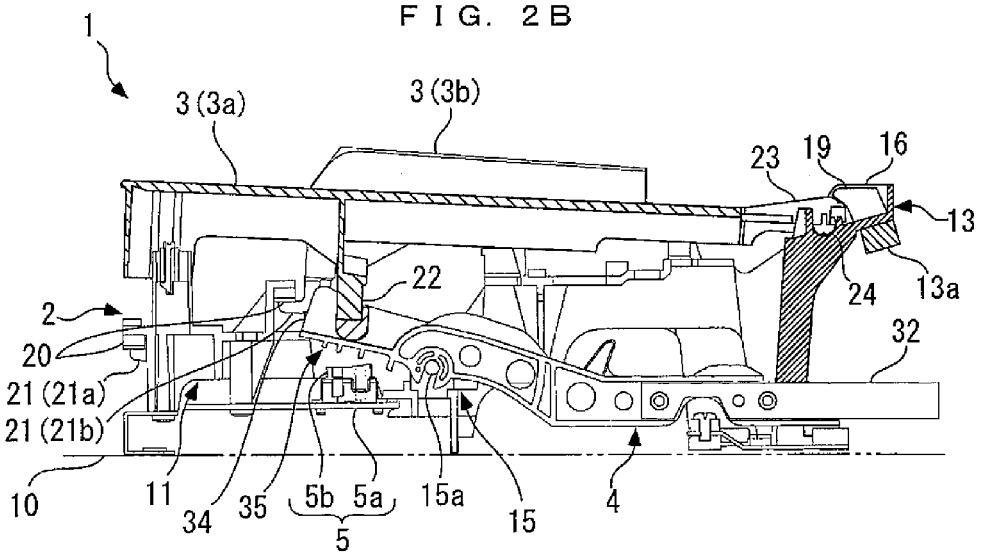
FIG. 2B is a cross-sectional view taken on line b-b of FIG. 2A.

The present invention will now be described in detail with reference to the drawings showing a preferred embodiment thereof. FIGS. 1, 2A, and 2B show a keyboard device, in a key-released state, of an electronic piano to which are applied a keyboard chassis and a key guide structure according to the embodiment. Note that FIGS. 1, 2A, and 2B show only a one-octave section of the keyboard device.

As shown in FIGS. 1, 2A, and 2B, the keyboard device 1 is comprised of a keyboard chassis 2, a plurality of keys 3 including white keys 3*a* and black keys 3*b* pivotally mounted on the keyboard chassis 2 and arranged in the left-right direction, a plurality of hammers 4 pivotally mounted on the keyboard chassis 2 in association with the respective keys 3, and a key switch 5 for detecting key depression information on the keys 3.

Figure 3A:
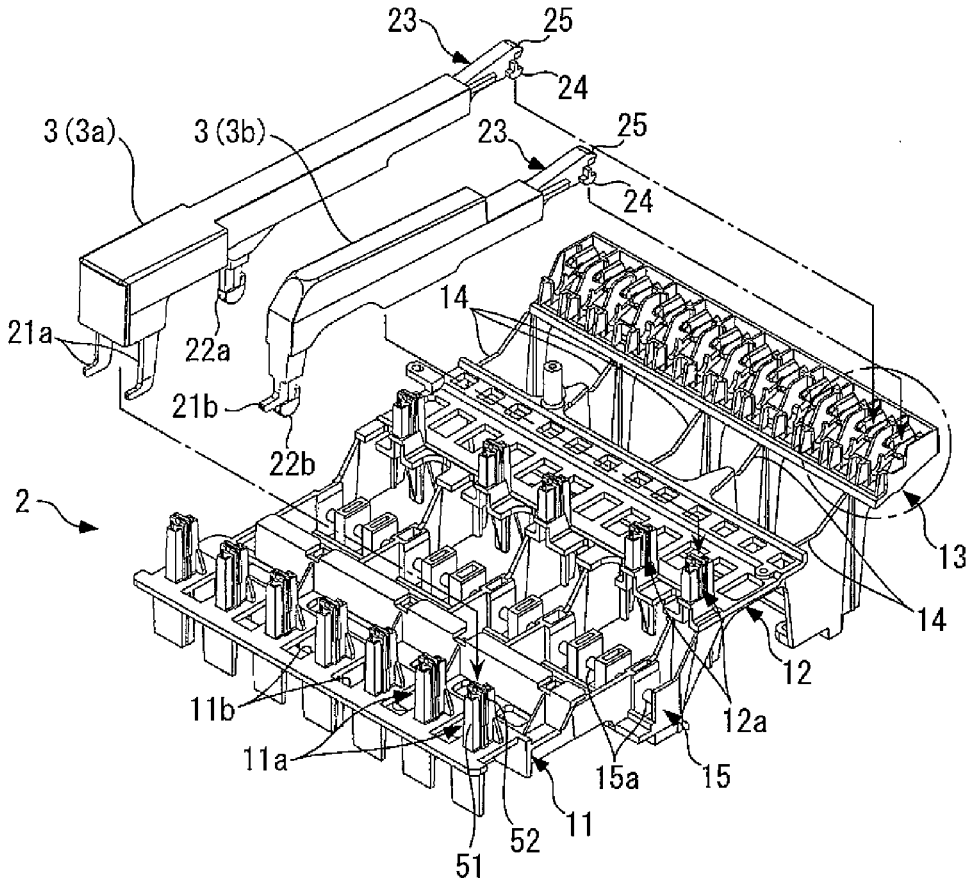
FIG. 3A is an exploded perspective view of a keyboard chassis and keys of the keyboard device in FIG. 1.

The keyboard chassis 2 is formed as a resin molded article which is made e.g. by injection molding of a predetermined resin material (e.g. an ABS resin) into a predetermined shape. As shown in FIG. 3A, the keyboard chassis 2 has a front part 11, a central part 12, and a rear part 13 each extending in the left-right direction as a whole. The front part 11, the central part 12, and the rear part 13 are connected to each other by a plurality of ribs 14 (connecting part) disposed with an appropriate spacing therebetween in the left-right direction. Note that in the following description, the front part 11, the central part 12, and the rear part 13 of the keyboard chassis 2 will be referred to as "the chassis front 11", "the chassis center 12", and "the chassis rear 13", respectively.

The chassis front 11 serves to guide the white keys 3*a*. The chassis front 11 has a plurality of (seven in FIG. 3A) white key guide parts 11*a* (key guide part) erected thereon and each inserted into an associated one of the white keys 3*a* from below so as to prevent lateral swing of the white key 3*a*. Further, the chassis front 11 has engagement holes 11*b* and 11*b*, vertically extending therethrough, formed on the respective left and right sides of each of the white key guide parts 11*a*. A pair of left and right upper limit position regulation parts 21*a* and 21*a*, referred to hereinafter, of the white key 3*a* are engaged with the respective engagement holes 11*b* and 11*b* in a state inserted therethrough.

The chassis center 12 serves to guide the black keys 3*b*. Similarly to the chassis front 11, the chassis center 12 has a plurality of (five, in FIG. 3A) black key guide parts 12*a* (key guide part) erected thereon and each inserted into an associated one of the black keys 3*a* from below so as to prevent lateral swing of the black key 3*b*. Further, at a location forward of the chassis center 12, there is disposed a hammer support part 15 for supporting the hammers 4. The hammer support part 15 has a plurality of support shafts 15*a* extending along a single straight line extending in the left-right direction, and the hammers 4 are pivotally supported by the support shafts 15*a*, respectively.

Further, between the hammer support part 15 and the chassis front 11, there is mounted the key switch 5. The key switch 5 is comprised of a laterally elongated printed circuit board 5*a* extending in the left-right direction and a plurality of switch bodies 5*b* each formed by a rubber switch and mounted on the printed circuit board 5*a* in association with each key 3.

Figure 3B:
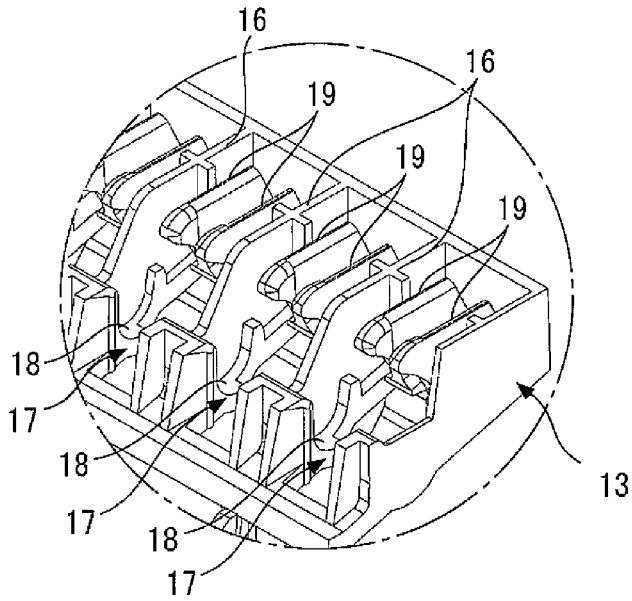
FIG. 3B is an enlarged perspective view of part of a rear end of the keyboard chassis.

The chassis rear 13 serves to support the keys 3 by their rear ends such that the keys 3 can pivotally move in the vertical direction. As shown in FIG. 3B, the chassis rear 13 is provided with a plurality of partition walls 16 which are formed with a predetermined spacing therebetween in the left-right direction such that adjacent keys 3 and 3 are separated from each other. Further, between each pair of adjacent ones of the partition walls 16, 16, there is formed a predetermined key support part 17 having a laterally symmetrical shape and configured to pivotally support an associated one of the keys 3. Specifically, the key support part 17 has left and right lower support portions 18 and 18 (only the left one of which is shown in FIG. 3B) for supporting, from below, respective left and right pivot shafts 24 and 24, referred to hereinafter, and a pair of left and right upper support portions 19 and 19 for supporting, from above, a portion of a rear end of the key 3 extending from the upper surface of the key 3 to the rear surface thereof.

Note that in the keyboard chassis 2 constructed as above, the chassis rear 13 corresponds to a rear support part of the present invention, while the chassis front 11, the chassis center 12, and the hammer support part 15 correspond to a front support part of the present invention.

Figure 4:
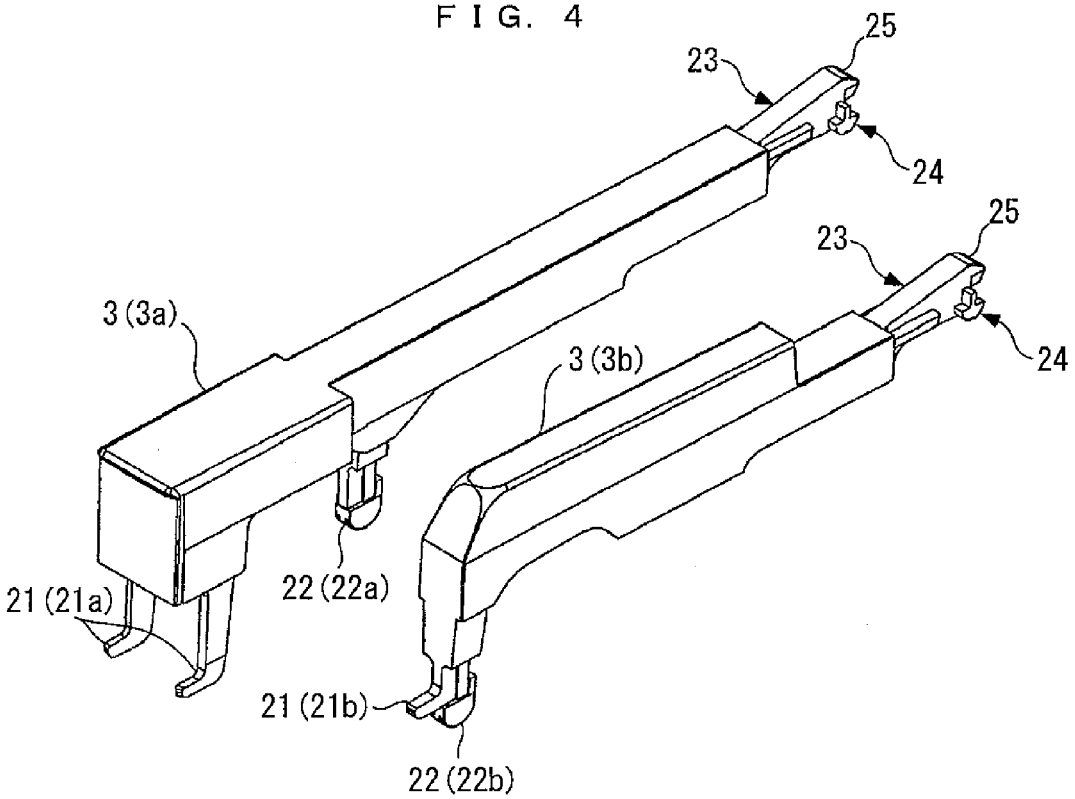
FIG. 4 is a perspective view of a white key and a black key.

The key 3 is formed e.g. by injection molding of a predetermined resin material (e.g. an AS resin) into a hollow shape which extends over a predetermined length in the front-rear direction and opens downward. As shown in FIGS. 3A and 4, the white key 3*a* has a front end thereof formed with the pair of left and right upper limit position regulation parts 21 (21*a*) which extend downward from respective side walls of the front end of the white key 3*a* and each having a lower end thereof bent forward. The upper limit position regulation parts 21 (21*a*) are engaged with the respective left and right engagement holes 11*b* and 11*b* in a state inserted therethrough. Further, the white key 3*a* has an actuator part 22 (22*a*), which projects downward, formed at a predetermined location rearward of the upper limit position regulation parts 21*a*. The actuator part 22*a* is engaged with an engagement recess 34, referred to hereinafter, of the hammer 4 in a state received therein. On the other hand, the black key 3*b* has a front end thereof formed with an upper limit position regulation part 21 (21*b*) and an actuator part 22 (22*b*), which have the same functions as those of the upper limit position regulation parts 21*a* and the actuator part 22*a* of the white key 3*a*.

Figure 5A:
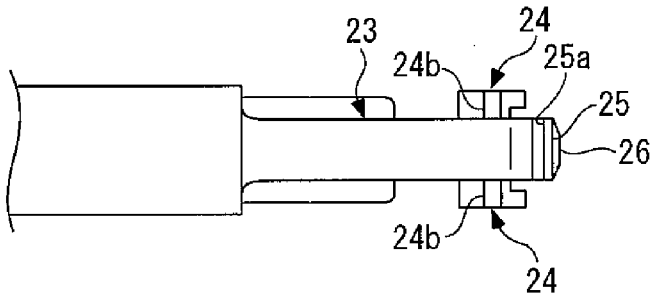
FIG. 5A is an enlarged plan view of a rear portion of the key.
Figure 5B:
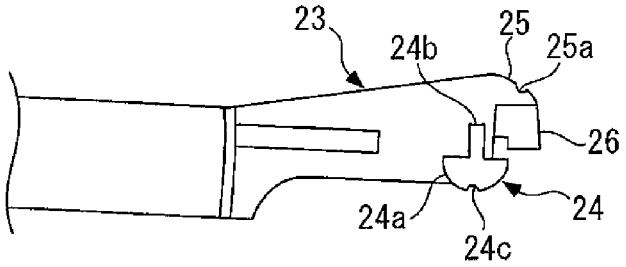
FIG. 5B is an enlarged right side view of the rear portion of the key.

As shown in FIGS. 4, 5A, and 5B, the key 3 has a rear part including a rear body 23 formed such that it has a smaller width than that of part of the key 3 forward thereof and extends in the front-rear direction. The pivot shafts 24 and 24, which protrude outward (i.e. leftward and rightward, respectively), are formed on the left and right side surfaces of the rear body 23 at respective predetermined locations close to a rear end of the rear body 23. Each of the pivot shafts 24 and 24 has a lower half formed as a semicircular portion 24*a* having an arcuate bottom surface and a semicircular side surface, and a protrusion 24*b* protruding upward from the center of the semicircular portion 24*a* in the front-rear direction. Note that the semicircular portion 24*a* of each of the pivot shafts 24 has a groove 24*c* formed in the arcuate bottom surface thereof, such that when lubricant, such as grease, is applied to the arcuate bottom surface of the semicircular portion 24*a*, the grease can be held therein for a long time.

The read end of the rear body 23 is formed such that a curved surface 25 with a predetermined curvature extends from the upper surface to the rear surface of the rear body 23. The curved surface 25 is formed to be convexly curved along a concentric circle about the pivot shaft 24 of the key 3 in side view. Further, the rear end of the rear body 23 has a tapered portion 26 continuous with the curved surface 25 and having a lateral width progressively reduced downward. Note that the curved surface 25 is formed with a groove 25*a* having the same function as that of the groove 24*c* of the pivot shaft 24.

Figure 6A:
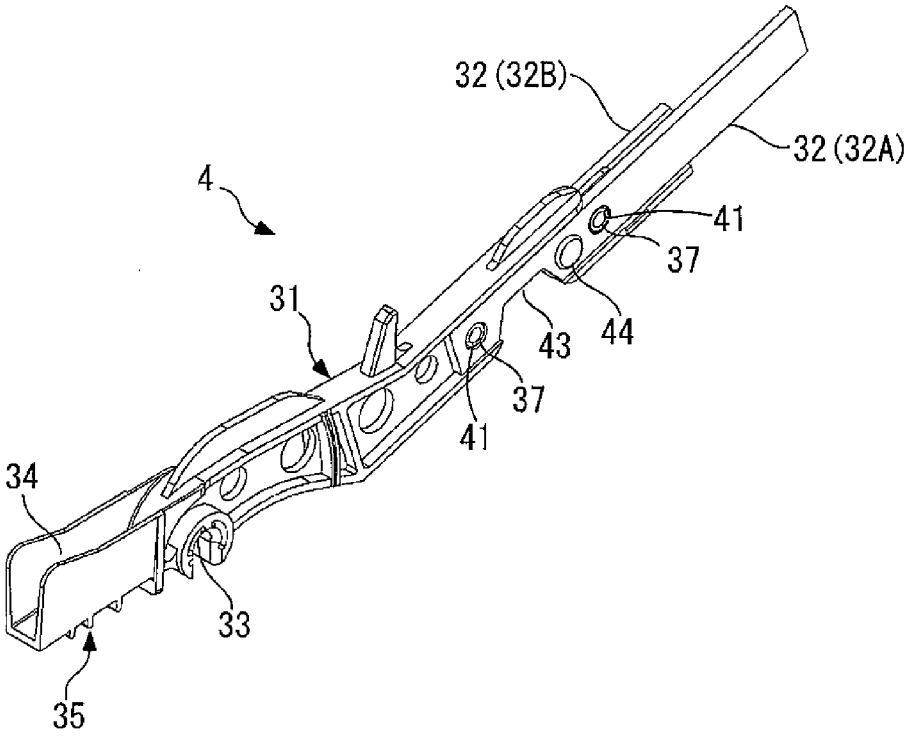
FIG. 6A is a perspective view of the appearance of a hammer.
Figure 6B:
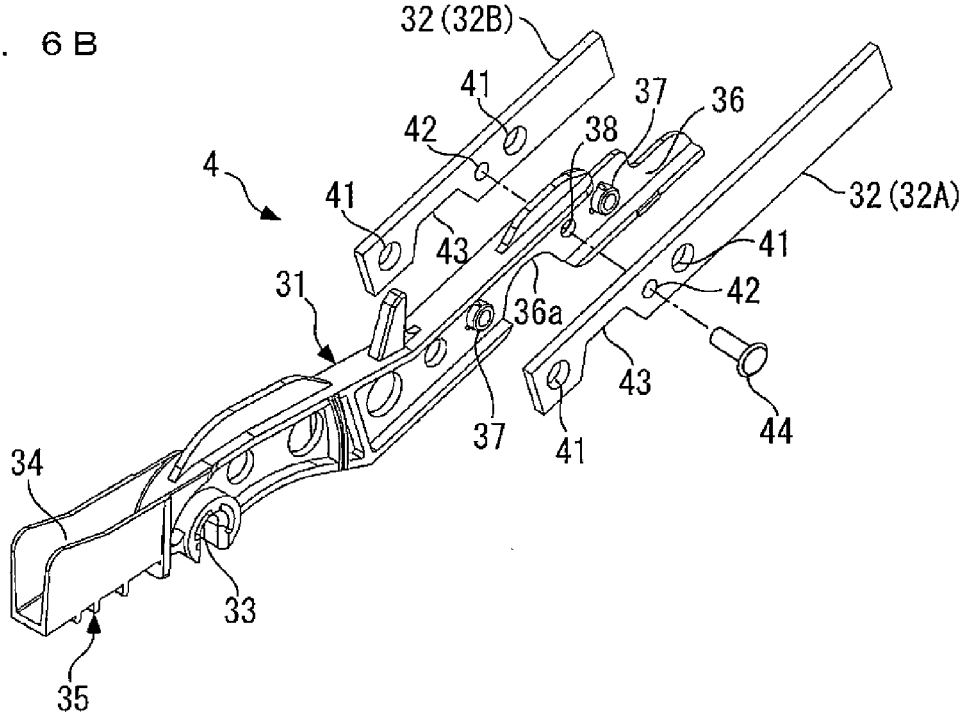
FIG. 6B is an exploded perspective view of the hammer disassembled into a hammer body and weights.

As shown in FIGS. 6A and 6B, the hammer 4 is comprised of a hammer body 31 and two weights 32 and 32 attached to the hammer body 31. The hammer body 31 is formed as a resin molded article which is made e.g. by injection molding of a predetermined resin material (e.g. POM (polyoexymethylene or polyacetal)) into a predetermined shape. The hammer body 31 extends over a predetermined length in the front-rear direction and has a bearing portion 33 formed at a predetermined location forward of the center of the hammer body 31 in the front-rear direction. The bearing portion 33 has an inverted U shape open downward in side view and is pivotally engaged with the support shaft 15*a* of the hammer support part 15 of the keyboard chassis 2. The engagement recess 34 for engagement with the actuator part 22 of the key 3 is formed in the front half of the hammer body 31 at a location forward of the bearing portion 33. The engagement recess 34 is open upward and forward, and the lower portion of the actuator part 22 of the key 3 is received in the engagement recess 34 in a state in which a lower end of the actuator part 22 is held in contact with a bottom surface of the engagement recess 34. Further, formed below the engagement recess 34 in the front half of the hammer body 31 are a plurality of switch pressing parts 35 for pressing the switch body 5*b* of the key switch 5.

A weight mounting portion 36 as a rear half of the hammer body 31 has two, i.e. front and rear, pairs of engagement protrusions 37 and 37 formed on the respective left and right side surfaces of the weight mounting portion 36 at predetermined locations, in a manner protruding outward, i.e. leftward and rightward, respectively, from the weight mounting portion 36, and a mounting hole 38 formed at a location close to the rear pair of engagement protrusions 37, in a manner extending through the weight mounting portion 36 in the left-right direction. Note that a cutout 36*a* is formed in a central portion of the weight mounting portion 36 so as to prevent screws and the like that fix the keyboard device 1 to a keybed 10 of an electronic piano (see FIG. 2B) from coming into abutment with the hammer 4 when the keyboard device 1 is in the key-released state.

The weights 32 are made of a material (metal such as steel) larger in specific gravity than the hammer body 31, and are formed as two long and narrow plates. Each of the weights 32 is formed in a predetermined shape e.g. by pressing a long metal plate having a predetermined thickness and width. Specifically, the weight 32 is formed with two, i.e. front and rear, engagement holes 41 and 41, a mounting hole 42, and a recess 43, which correspond, respectively, to the two engagement protrusions 37 and 37, the mounting hole 38, and the cutout 36*a* formed in the hammer body 31. The two weights 32 and 32 are rigidly secured to the hammer body 31 in a state sandwiching the weight mounting portion 36 of the hammer body 31, by riveting rivets 44 inserted through the mounting holes 42, 42, and 38.

One of the weights attached to each of the hammers 4 (hereinafter referred to as "the common weight 32A") has a predetermined length and is common to all the hammers 4. On the other hand, the other weight (hereinafter referred to as "the adjustment weight 32B") is formed to have a length equal to or smaller than that of the common weight 32A. Therefore, it is possible to change the weight of the hammer 4 including the two weights 32A and 32B by adjusting the length of the adjustment weight 32B.

In the keyboard device 1 constructed as above, when the key 3 is depressed in the key-released state shown in FIGS. 1 and 2B, the key 3 pivotally moves downward about the left and right pivot shafts 24 and 24 of the rear end of the key 3. In accordance with this pivotal motion of the key 3, the actuator part 22 of the key 3 presses the engagement recess 34 of the hammer 4 downward. As a consequence, the hammer 4 presses the associated switch body 5*b* of the key switch 5 from above by the switch pressing portion 35 while pivotally moving in the counterclockwise direction, as viewed in FIG. 2B, about the support shaft 15*a* of the hammer support part 15. In this case, the rear end of the hammer 4 (i.e. the rear end of the common weight 32A) is brought into abutment with a hammer stopper 13*a* of the chassis rear 13 from below, whereby further pivotal motion of the hammer 4 is inhibited. By the key depressing operation described above, a predetermined touch weight corresponding to the weight and torque of the hammer 4 is imparted to the key 3, and also key depression information on the key 3 is detected via the key switch 5.

On the other hand, when the depressed key 3 is released, the hammer 4 pivotally moves in a direction opposite to the above-mentioned direction, i.e. in the clockwise direction as viewed in FIG. 2B. In accordance with this pivotal motion of the hammer 4, the key 3 is pushed upward via the actuator part 22 and pivotally moves upward. As a consequence, the key 3 and the hammer 4 return to their key-released state as shown in FIGS. 1 and 2B. In this case, the upper limit position regulation parts 21 of the front end of the key 3 are brought into abutment with a predetermined stopper 20 of the keyboard chassis 2 from below, whereby further pivotal motion of the key 3 is inhibited.

Next, a further detailed description will be given of the keyboard chassis 2 according to the present invention with reference to FIGS. 3A, 7A, and 7B, focusing on the structure of the ribs 14 connecting the chassis rear 13 (rear support part) and the assembly (front support part) of the chassis front 11, the chassis center 12 and the hammer support part 15 in the front-rear direction.

Figure 7A:
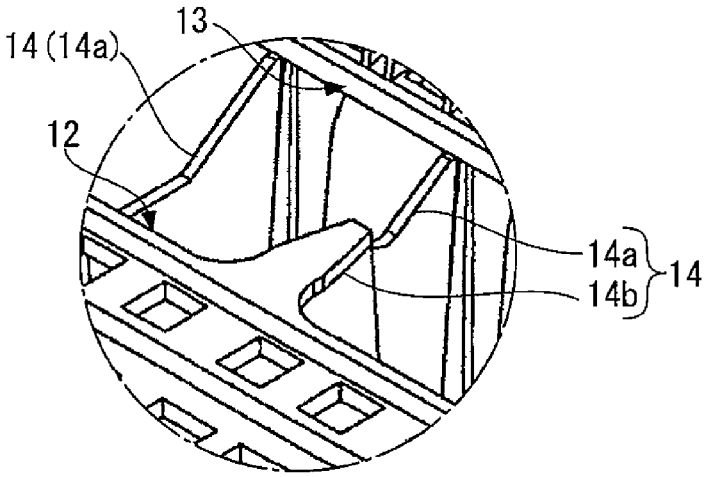
Figure 7B:
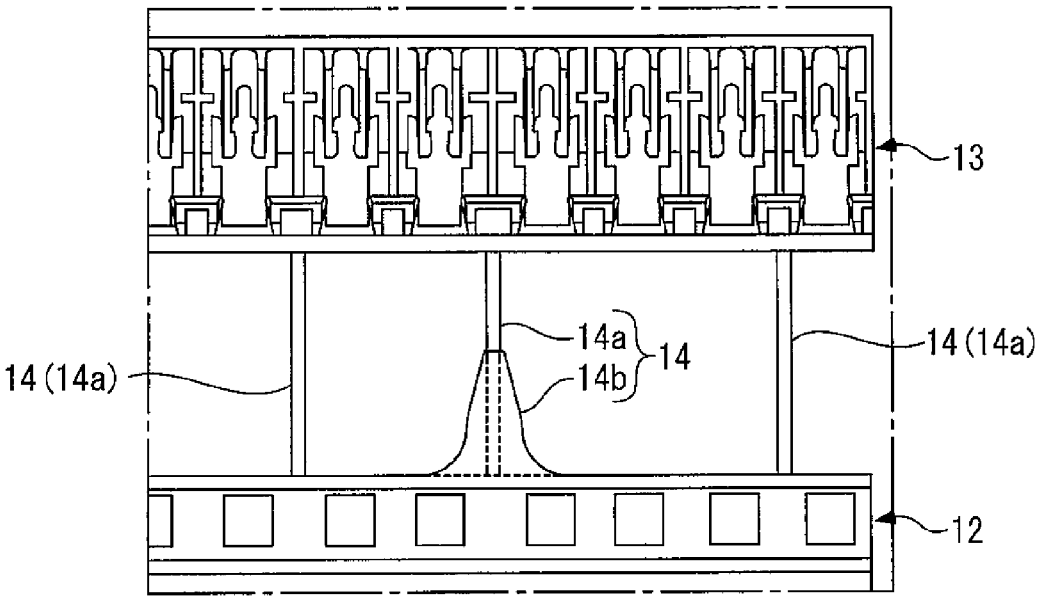

FIGS. 7A and 7B are a perspective view and a plan view showing, on an enlarged scale, the ribs 14 that serve to connect between the chassis rear 13 and the chassis center 12 of the keyboard chassis 2 shown in FIG. 3A. As shown in FIG. 3A, the keyboard chassis 2 is provided with the five ribs 14, at every two or three keys 3 (hammers 4), in a manner spaced from each other in the left-right direction. Each rib 14 has a rib body 14*a* (vertical rib) which is formed in a plate shape having a predetermined thickness in the left-right direction and continuous between the chassis center 12 and the chassis rear 13, and predetermined two of the ribs 14 each have a reinforcement rib 14*b* for reinforcing the rib 14, which is provided on an upper end of the rib body 14*a*.

The reinforcement rib 14*b* is formed such that it has a plate shape having a predetermined thickness in the vertical direction, and it has a width in the left-right direction larger than the thickness of the rib body 14*a*. Further, the reinforcement rib 14*b* is formed such that its width is progressively increased from the center of the upper end of the rib body 14*a* in the front-rear direction toward the chassis center 12.

As described in detail above, according to the keyboard chassis 2 of the present embodiment, the ribs 14 connect between the chassis rear 13 for pivotally supporting the keys 3 and the chassis center 12 for guiding black keys 3*b*. Further, one of adjacent ones of the ribs 14 has the reinforcement rib 14*b* provided on the upper end of its rib body 14*a*. This makes it possible to dramatically increase the strength of the rib 14 in comparison with a case where the rib 14 has the rib body 14*a* alone and to reduce the number of ribs 14, while ensuring sufficient rigidity of the keyboard chassis 2, in comparison with a conventional keyboard chassis in which vertical ribs are arranged in a manner each separating hammers adjacent to each other in the left-right direction. As a consequence, it is possible to reduce the amount of a synthetic resin used as a material, compared with the amount of a synthetic resin used in the conventional keyboard chassis, and ensure sufficient rigidity of the keyboard chassis 2. In addition, it is possible to prevent deformation of the keyboard chassis 2 even when the electronic piano is stored in an upright position.

Note that the keyboard chassis 2 according to the present invention is not limited to the above-described embodiment, but the present invention can be practiced in various forms. For example, in the one-octave section of the keyboard chassis 2 of the present embodiment, two of the five ribs 14 are provided with reinforcement ribs 14*b*, respectively, but it is possible to provide a reinforcement rib 14*b* for each of the ribs 14. Alternatively, it is possible to provide a reinforcement rib 14*b* for only one of the ribs 14 when sufficient strength and rigidity of the keyboard chassis 2 can be ensured.

Further, although in the present embodiment, the reinforcement rib 14*b* is formed such that its width is progressively increased from the chassis rear 13 toward the chassis center 12, the shape of the reinforcement rib 14*b* is not limited to this, but in contrast to the above, it is also possible to form the reinforcement rib 14*b* such that its width is progressively increased from the chassis center 12 toward the chassis rear 13. The detailed structure of the keyboard chassis 2 of the present embodiment is described only by way of example, and it can be changed, as desired, within the scope of the subject matter of the present invention.

Next, a further detailed description will be given of the key guide structure according to the present invention with reference to FIGS. 3A, 3B, and 8A to 11B, focusing on the construction of the white key guide part 11*a* of the chassis front 11 and that of the white key 3*a* to be guided by the white key guide part 11*a*.

Figure 8A:
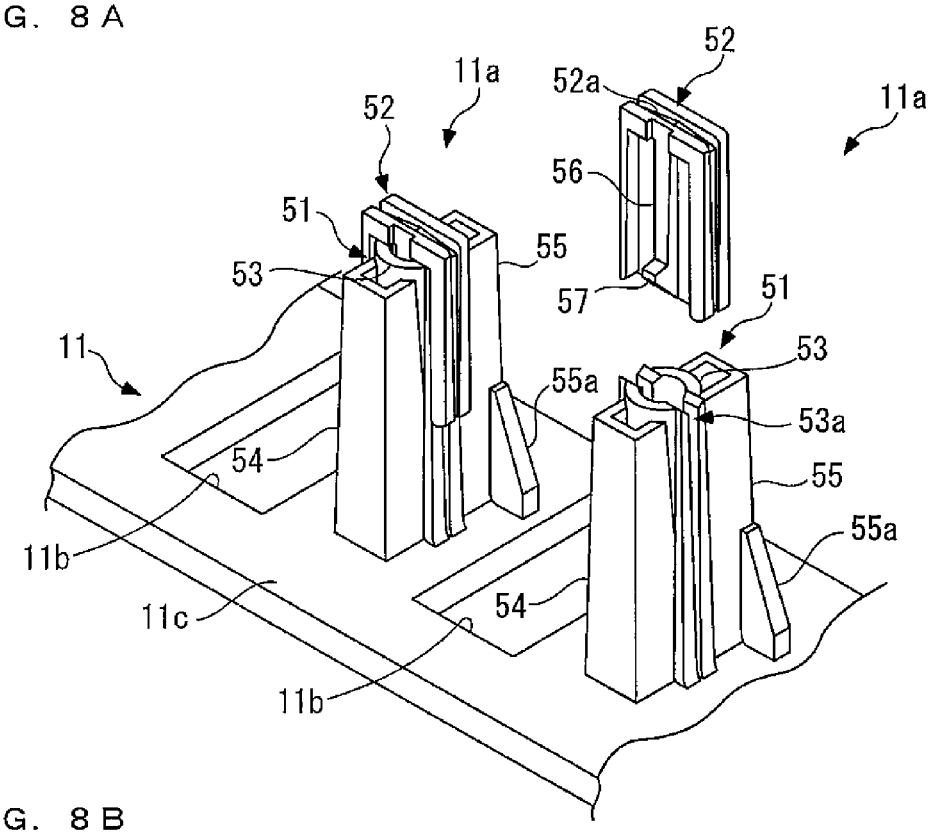
Figure 8B:
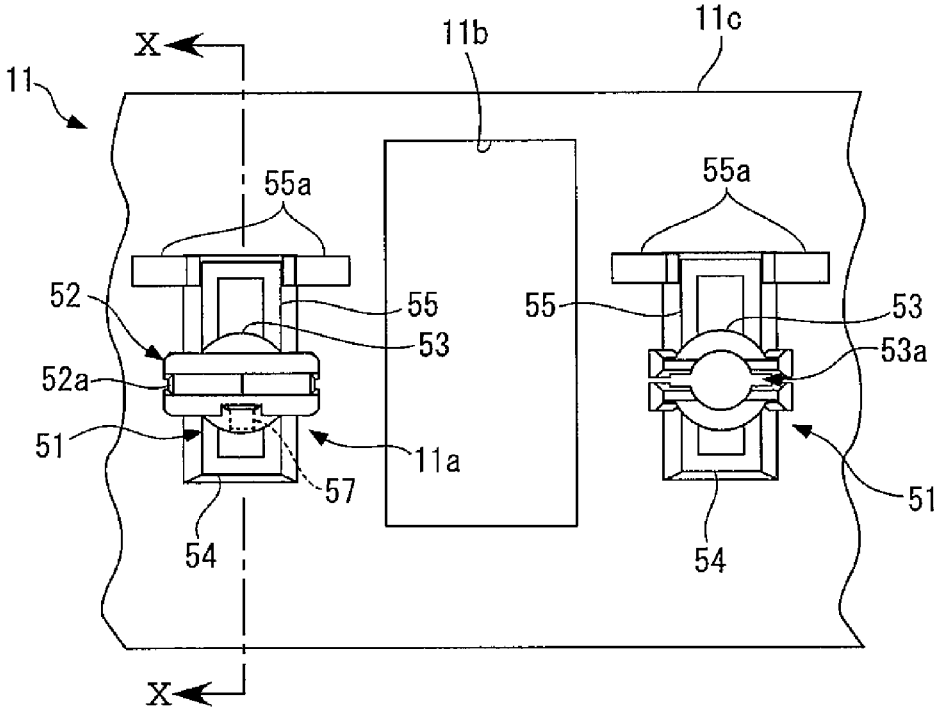

FIGS. 8A and 8B show two white key guide parts 11*a* of the chassis front 11. One (left one in FIGS. 8A and 8B) of the white key guide parts 11*a* is in a state where a key guide body 52, referred to hereinafter, has been mounted thereto, and the other (right one in FIGS. 8A and 8B) of the white key guide parts 11*a* is in a state where the key guide body 52 has been removed therefrom. As shown in FIG. 8A, each of the white key guide parts 11*a* is comprised of a key guide holder 51 erected on a horizontal flat part 11*c* of the chassis front 11 and the key guide body 52 mounted to the key guide holder 51.

The key guide holder 51 is integrally formed with the keyboard chassis 2, and has a hollow cylindrical holder part 53 (holder body) extending vertically over a predetermined length and reinforcement parts 54 and 55 erected on the flat part 11*c* in a manner continuous with the front and rear of the holder part 53, respectively. The holder part 53 provided with a slit-shaped mounting portion 53*a* that extends vertically in a state open upward and with a slit extending therethrough in the left-right direction, and the key guide body 52 is mounted in the mounting portion 53*a*. Each of the front and rear reinforcement parts 54 and 55 has a U shape, in plan view, open toward the holder part 53. Note that the rear reinforcement part 55 is provided with auxiliary reinforcement parts 55*a* and 55*a* erected on the flat part 11*c* in a manner continuous with the respective left and right side surfaces of the lower half of the rear reinforcement part 55.

Figure 9A:
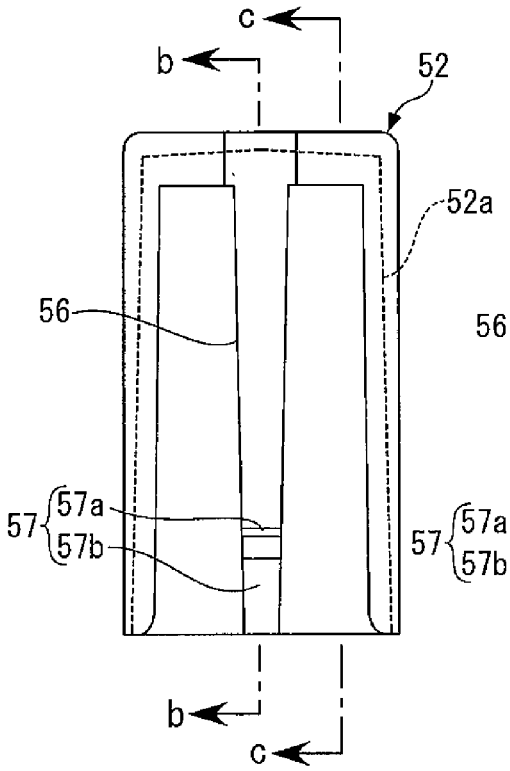
FIG. 9A is a front view of the key guide body.
Figure 9B:
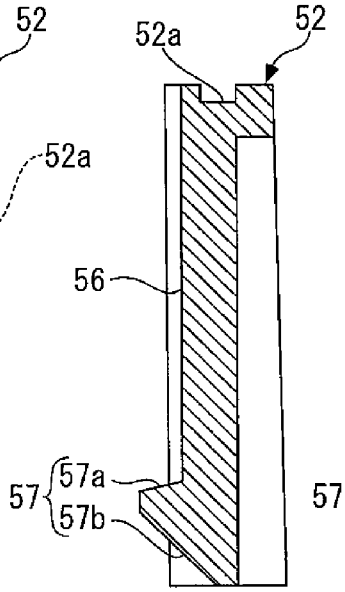
FIG. 9B is a cross-sectional view taken on line b-b of FIG. 9A.
Figure 9C:
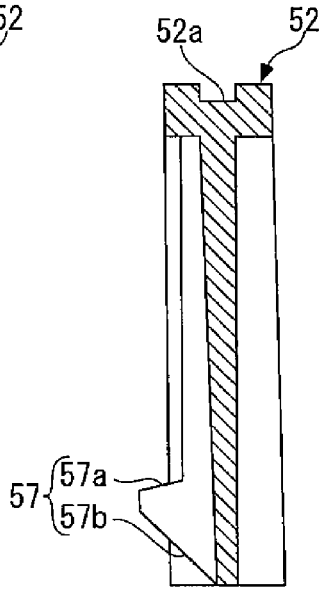
FIG. 9C is a cross-sectional view taken on line c-c of FIG. 9A.

On the other hand, the key guide body 52 is made of a soft synthetic resin (e.g. elastomer) and has a vertically elongated plate shape. More specifically, as shown in FIGS. 9A to 9C, the key guide body 52 is formed in a vertically elongated rectangular shape in front view, and its top and left and right end portions have respective predetermined thicknesses and are formed such that the end portions are made thicker than the other portions. Further, the end portions of the key guide body 52 are formed with a groove 52*a* which extends along the periphery. When lubricant, such as grease, is applied to the end portions of the key guide body 52, part of the lubricant enters the groove 52*a* to be held therein. This makes it possible to maintain the state where the grease is held on the left and right side surfaces for a long time, so that lubricity between left and right guide walls 61 and 61, referred to hereinafter, of the key 3, and the left and right side surfaces of the key guide body 52 can be ensured during key depression.

Further, the key guide body 52 has an insertion portion 56 provided in the center of the front surface thereof which is formed to extend vertically, for being inserted into the holder part 53 of the key guide holder 51. As shown in FIGS. 9A and 9B, the insertion portion 56 is formed to be relatively thick in the front-rear direction and have a lateral width progressively reduced downward. Furthermore, the insertion portion 56 has a lower end formed with an engagement protrusion 57 (retaining portion) protruding forward. The engagement protrusion 57 has a engagement surface 57*a* which is substantially horizontal and a sloped surface 57*b* which is sloped forward and upward at a location downward of the engagement surface 57*a*.

Figure 10:
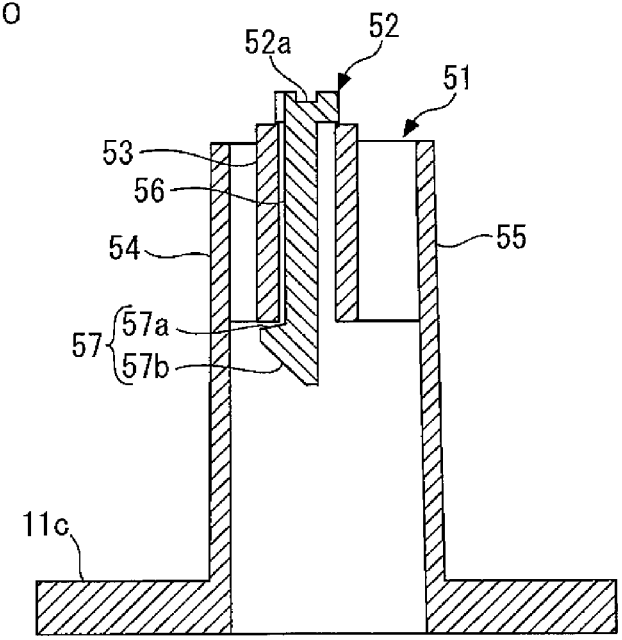
FIG. 10 is a cross-sectional view of the white key guide part, taken on line X-X of FIG. 8B.

In the key guide holder 51 and the key guide body 52 constructed as above, the key guide body 52 is mounted to the key guide holder 51 with the insertion portion 56 in the center of the key guide body 52 being inserted from above into the mounting portion 53*a* of the holder part 53 of the key guide holder 51. In this case, the key guide body 52 is mounted with its top and left and right end portions projecting outward of the holder part 53 of the key guide holder 51 as shown in FIG. 8A. Further, as shown in FIG. 10, the engagement protrusion 57 of the key guide body 52 is positioned below the holder part 53 of the key guide holder 51, and the engagement surface 57*a* of the engagement protrusion 57 is latched by the lower end of the holder part 53. This causes the key guide body 52 to be securely mounted to the key guide holder 51 in a retained state.

Figure 11A:
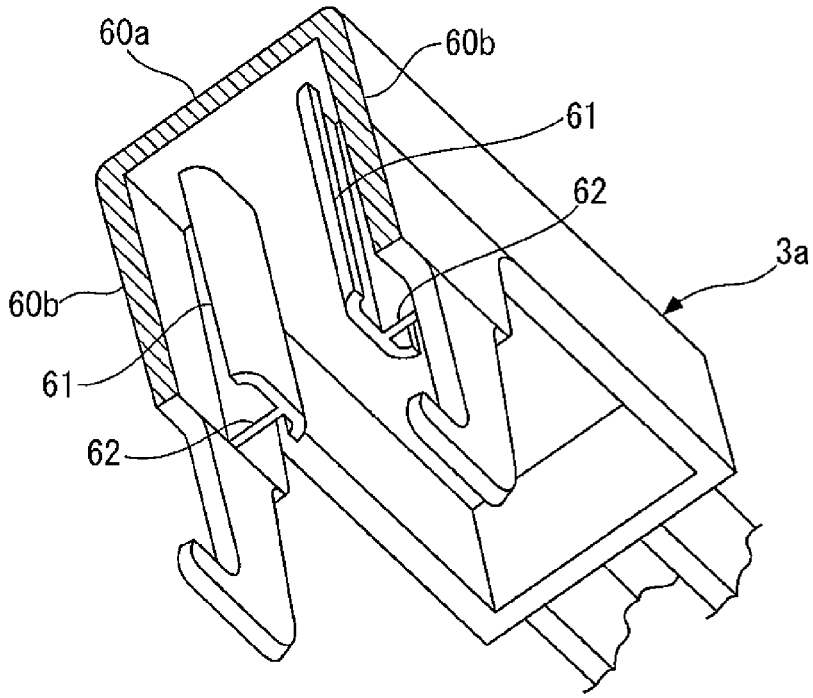
Figure 11B:
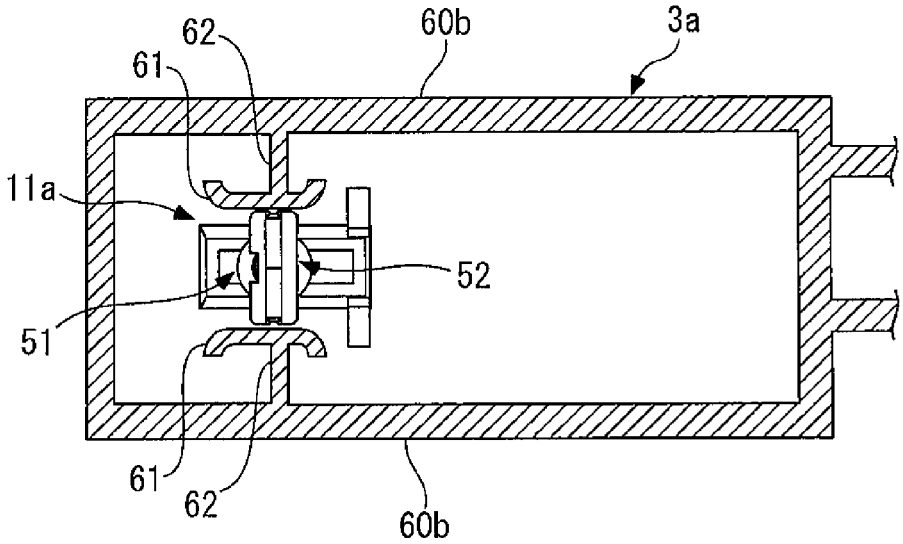

FIGS. 11A and 11B show a front portion of the white key 3*a*. FIG. 11A illustrates the internal construction of the front portion of the white key 3*a*, and FIG. 11B shows the relationship between the white key 3*a* and the white key guide part 11*a*. As shown in FIGS. 11A and 11B, in the front portion of the white key 3*a*, there are provided the left and right guide walls 61 and 61 with a predetermined spacing in the left-right direction. Each of the guide walls 61 is integrally formed with the white key 3*a* via a spacer 62 which extends vertically over a predetermined length from a top wall 60*a* of the white key 3*a* and projects inward over a predetermined length from an associated one of side walls 60*b* of the white key 3*a*. The distance between the left and right guide walls 61 and 61 is set to approximately the same dimension as the lateral width of the key guide body 52, and the two guide walls 61 and 61 form a guide recess of the present invention, which is open downward and with which the left and right side surfaces of the key guide body 52 are brought into sliding contact.

When the white key 3*a* having the left and right guide walls 61 and 61 constructed as above is depressed, the white key 3*a* pivotally moving about the pivot shafts 24 of the rear end thereof is smoothly guided without laterally swinging, with the two guide walls 61 and 61 held in sliding contact with the respective left and right side surfaces of the key guide body 52 of the white key guide part 11*a*.

Although detailed description is omitted, the black key guide part 12*a* for guiding the black key 3*b* has the same key guide body as the key guide body 52 of the white key guide part 11*a*, and the key guide body is configured to be held in direct sliding contact with the left and right side walls of the black key 3*b*.

As described in detail above, according to the key guide structure of the present embodiment, the key guide body 52 for guiding the pivotally moving key 3 is made of a soft synthetic resin, so that even when the guide walls 61, etc. of the key 3 rub against the key guide body 52, slide sound generated at the time can be reduced dramatically, which makes it possible to guide the key 3 stably without causing noise. Further, since the key guide body 52 is formed in a plate shape, it is possible to reduce the amount of a synthetic resin used as a material in comparison with the prior art in which the guide member is formed in a cylindrical shape, so that reduction of manufacturing costs can be achieved.

Further, as for the white key 3*b*, the left and right guide walls 61 and 61 spaced inward from the respective left and right side walls 60*b* and 60*b* of the white key 3*b* are held in sliding contact with the key guide body 52 of the white key guide part 11*a*, so that even when a relatively large amount of lubricant has been applied to the left and right side walls of the key guide body 52, it is possible to positively prevent the lubricant from leaking out from the white key 3*b* (side walls 60*b*).

Furthermore, as for the key guide holder 51, since the reinforcement parts 54 and 55 are provided at locations forward and rearward of the holder part 53 having the key guide body 52 mounted thereto, it is possible to securely reinforce the holder part 53 against load applied to the same from any of its front, rear, left, and right sides to thereby securely hold the key guide body 52 mounted to the holder part 53.

Note that the key guide structure of the present invention is not limited to the above-described embodiment, but the present invention can be practiced in various forms. For example, although in the key guide holder 51 in the above-described embodiment, the holder part 53 to which the key guide body 52 is mounted is formed in a hollow cylindrical shape and the reinforcement parts 54 and 55 each having a hollow prism shape are disposed at respective locations forward and rearward of the holder part 53, the holder part 53 may have not the hollow cylindrical shape, but a hollow shape (e.g. hollow prism shape) other than the hollow cylindrical shape. Further, one of the two reinforcement parts 54 and 55 can be omitted, or the shape of the two reinforcement part can be changed to another shape (e.g. hollow cylindrical shape or plate shape).

Further, the detailed construction, material, etc. of each of the key guide holder 51, the key guide body 52, and the key 3 constituting the key guide structure of the present invention are described only by way of example, and therefore these can be changed, as desired, within the scope of the subject matter of the present invention.

What is claimed is:

1. A keyboard chassis for a keyboard instrument, which is formed as a molded article made of a synthetic resin and configured to support a plurality of keys and hammers each extending in a front-rear direction, in a state arranged in a left-right direction, including:

a rear support part configured to pivotally support a rear end of each of the keys, a front support part disposed forward of said rear support part with a spacing therefrom, and having a key guide part that guides the keys each pivotally moved by key depression and/or a hammer support part that pivotally supports the hammers each moved in a manner interlocked with the key depression, and a plurality of connection parts disposed with a spacing therebetween in the left-right direction and configured to connect between said rear support part and said front support part, wherein each connection part comprises:

a vertical rib formed in a plate shape having a predetermined thickness in the left-right direction and continuous with said rear support part and said front support part; and a reinforcement rib formed in a plate shape having a predetermined thickness in a vertical direction, and disposed on an upper end of said vertical rib between said rear support part and said front support part, with a width made larger in the left-right direction than the thickness of said vertical rib.

2. The keyboard chassis according to claim 1, wherein said plurality of connection parts are each provided for every predetermined two or larger number of keys and/or hammers.

3. The keyboard chassis according to claim 1, wherein said reinforcement rib is formed such that the width in the left-right direction is progressively increased from one of said rear support part and said front support part toward the other.

4. A key guide structure for a keyboard instrument including a plurality of keys each extending in a front-rear direction, having a rear end thereof pivotally supported on a keyboard chassis, and having a guide recess open downward, the key guide structure provided for guiding each key pivotally moved by key depression, comprising:

a plurality of key guide holders each of which has a mounting portion open upward and extending therethrough in a left-right direction, and is provided for each of the keys, in a manner erected on the keyboard chassis at a location below the guide recess; and a plurality of key guide bodies each of which is made of a soft synthetic resin and formed in a plate shape having a width substantially identical in dimension to an inner width of the guide recess of the key in the left-right direction, each key guide body being mounted in the mounting portion of an associated one of said key guide holders in a state inserted therein from above, for being brought into sliding contact with left and right inner side surfaces of the guide recess of the associated key.

5. The key guide structure according to claim 4, wherein the key includes:

left and right, side walls with a predetermined spacing therebetween in the left-right direction, and left and right guide walls that are provided at respective locations spaced inward from said left and right side walls by a predetermined distance, in a manner spaced from each other by a distance substantially equal to a lateral width of said key guide body in the left-right direction, said left and right guide walls forming left and right walls of the guide recess, respectively.

6. The key guide structure according to claim 4, wherein said key guide body has left and right side surfaces each formed with a groove for holding a lubricant.

7. The key guide structure according to claim 4, wherein said key guide body has a retaining portion provided at a lower end thereof, said retaining portion being configured to be engaged with said key guide holder in a retained state when said key guide body is mounted in the mounting portion.

8. The key guide structure according to claim 4, wherein said key guide holder includes:

a holder body formed in a hollow cylindrical shape extending vertically and having the mounting portion, and a reinforcement part erected on the keyboard chassis at at least one of locations forward and rearward of said holder body, in a state continuous with said holder body.

9. The key guide structure according to claim 8, wherein said reinforcement part is formed in a hollow shape extending vertically.

* * * * *